US005826377A

United States Patent [19]

Simson et al.

[11] Patent Number: 5,826,377

[45] Date of Patent: Oct. 27, 1998

[54] REMOTELY-DRIVEN POWER WINDOW

[76] Inventors: Anton K. Simson; Todd A. Simson, both of 13227 Aubrey St., Poway, Calif. 92064

[21] Appl. No.: 704,025

[22] Filed: Aug. 29, 1996

[51] Int. Cl.[6] ..... E05F 11/34

[52] U.S. Cl. ..... 49/362; 49/409

[58] Field of Search ..... 49/360, 362, 404, 49/409

[56] References Cited

U.S. PATENT DOCUMENTS

| | | | |
|---|---|---|---|
| 2,056,174 | 10/1936 | Farhutt et al. | 49/362 X |
| 3,714,738 | 2/1973 | Koslow et al. | 49/404 |
| 4,229,907 | 10/1980 | Hall | 49/362 |
| 4,409,905 | 10/1983 | Zerbi | 49/362 X |
| 4,475,312 | 10/1984 | Deutschle | 49/409 X |
| 4,698,938 | 10/1987 | Huber | 49/362 X |
| 4,819,297 | 4/1989 | Jacobs et al. | 49/409 X |
| 4,887,394 | 12/1989 | Marlowe | 49/409 |
| 4,995,195 | 2/1991 | Olberding et al. | 49/362 X |
| 5,355,624 | 10/1994 | Bacon | 49/280 |

*Primary Examiner*—Peter R. Brown
*Attorney, Agent, or Firm*—Henri J. A. Charmasson; John D. Buchaca

[57] ABSTRACT

A mechanism for the powered opening and closing of household panels such as windows and doors comprises a worm drive screw, small enough to be mounted within and along the upper track of a sliding panel. A nut threaded on the drive screw moves axially along the screw when the screw is rotated. Motion of the nut is transmitted to the panel by means of a coupling bolt, slidingly mounted within a cavity in the top of the panel. The bolt slides up to engage the nut for powered operation, and slides down to disengage from the nut during manual operation. The position of the bolt can be secured through locking means. A resilient, dielectric transmission accouplement between the drive screw and the motor provides electrical and vibrational isolation, and scalability. A second extendible bolt mounted on an opposite end of the frame hinders pitch deflection of the panel during powered operation. Worm gearing and a solenoid based brake locks the motor and the position of the nut when no power is applied.

20 Claims, 3 Drawing Sheets

REMOTELY-DRIVEN POWER WINDOW

FIELD OF THE INVENTION

This invention relates to powered mechanisms for opening and closing of household panels such as windows and doors and more particularly to sliding windows and doors which are mounted on tracks.

BACKGROUND OF THE INVENTION

Mechanisms for the powered opening and closing of household panels such as windows benefit from the optimization of several factors. It is desirable to have a device which is:

1) Inexpensive and easy to manufacture, install and operate;

2) Easily and quickly transformed from powered to manual operation;

3) Aesthetically appealing both visually and aurally;

4) Safe, especially with respect to children;

5) Secure with respect to forced entry from outside the home; and

6) Readily scalable, covering a multitude of sliding panel designs and sizes.

Related art is described by Bacon in U.S. Pat. No. 5,355,624. Disclosed are a drive mechanism comprising permanently engaged rack and pinion gears. A locking pin disengages from the rack during powered operation through means of a solenoid, operatively associated with the drive motor.

Although the Bacon device is appealing, it suffers from several drawbacks. First, manual operation is inconvenient and possibly dangerous. Opening the window requires two hands—one to temporarily disengage the locking pin, and another to move the window. In the event of an emergency where a power outage or breakdown has occurred, a child or a person without a free hand may have difficulty in manually opening the window. Since the motor and gearing are always engaged, they will provide some resistance to manual movement of the window. In addition, this will likely cause increased wear in the gearing and motor bearings.

Second, this design requires relatively expensive, precise installation. Existing windows would have to be extensively modified by attaching the rack to the edge of the window panel, cutting a slot in the track for the rack to extend through, and further modifying the upper or lower sill to accept the motor and pinion assembly.

Other drawbacks are anticipated, such as, noise from the motor being transmitted directly through the gearing to the window and sill. When the rack slot is located below the bottom sill, it exposes the mechanisms to a greater amount of dirt and grit. In addition, the mechanisms may be within the reach of children's fingers. If an electrical short occurs between the motor and its casing, it is possible that portions of the window or sill made from conductive material such as aluminum may become electrically charged, creating a shock or fire hazard.

Therefore, it would be beneficial to have a remotely powered window drive mechanism which does not suffer from the above-mentioned drawbacks.

SUMMARY OF THE INVENTION

The principal and secondary objects of this invention are to provide a simple, inexpensive, safe, scalable and aesthetically appealing mechanism for the powered opening and closing of household panels such as sliding windows and doors.

These and other objects are achieved by a worm drive screw, mounted within and along the upper track of a sliding panel. A nut threaded onto the drive screw moves axially along the screw as the screw is rotated. Motion of the nut is transmitted to the panel by means of a coupling bolt slidingly mounted within a cavity set into the top of the panel. The bolt slides up to engage the nut for powered operation and slides down to disengage from the nut during manual operation. The position of the bolt can be secured through locking means.

Additional features include: 1) a resilient, dielectric transmission accouplement between-the drive screw and the motor to provide electrical and vibrational isolation, and scalability by changing the length of the accouplement; 2) a second extendible bolt mounted on an opposite end of the panel to hinder pitch deflection of the panel during powered operation; and 3) worm gearing in the motor and/or a motor braking mechanism to lock the position of the nut when no power is applied.

DESCRIPTION OF THE PREFERRED EMBODIMENT OF THE INVENTION

Figure 1:
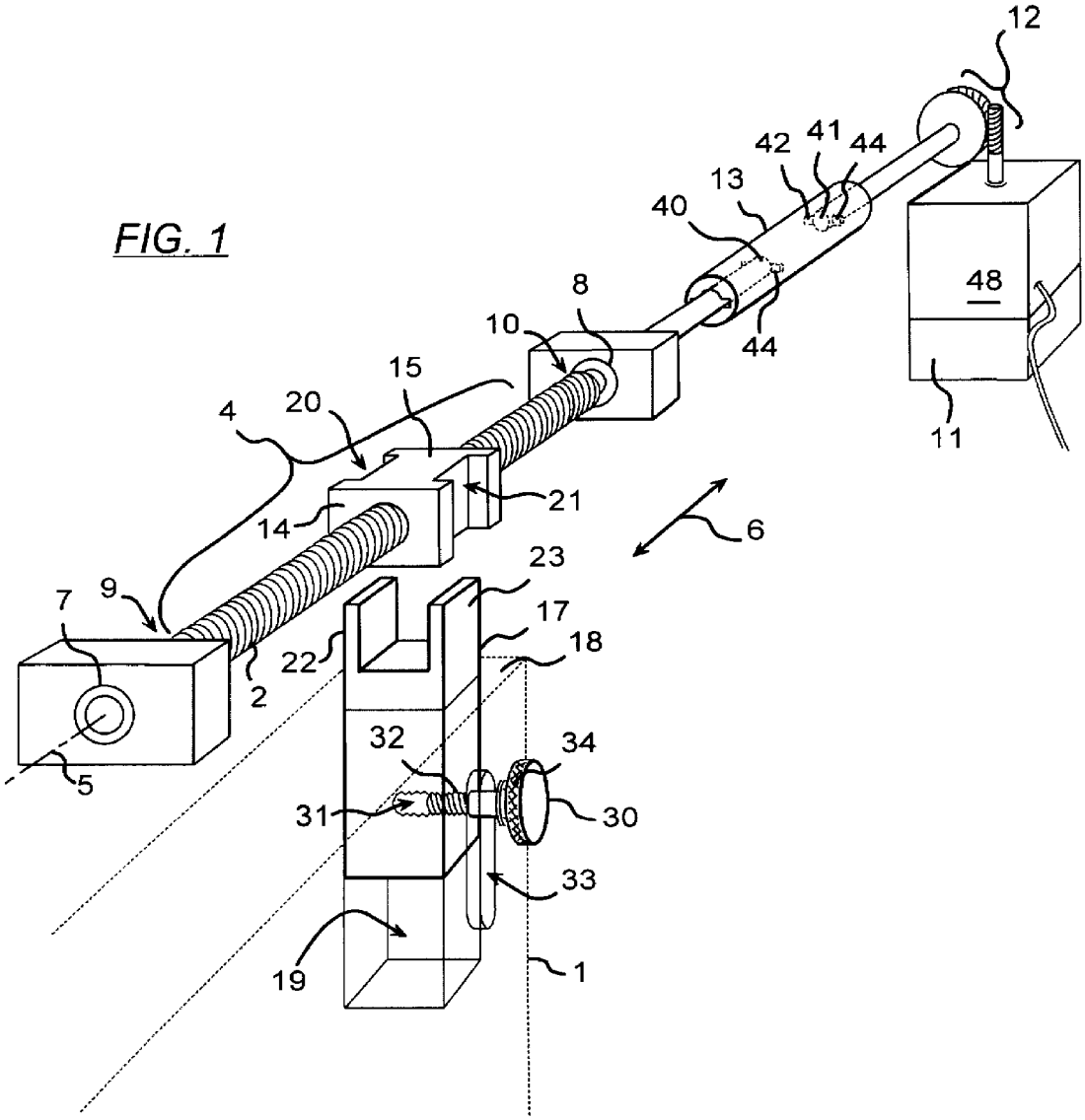
FIG. 1 is a partially transparent, perspective diagrammatic view of several components of the invention.
Figure 2:
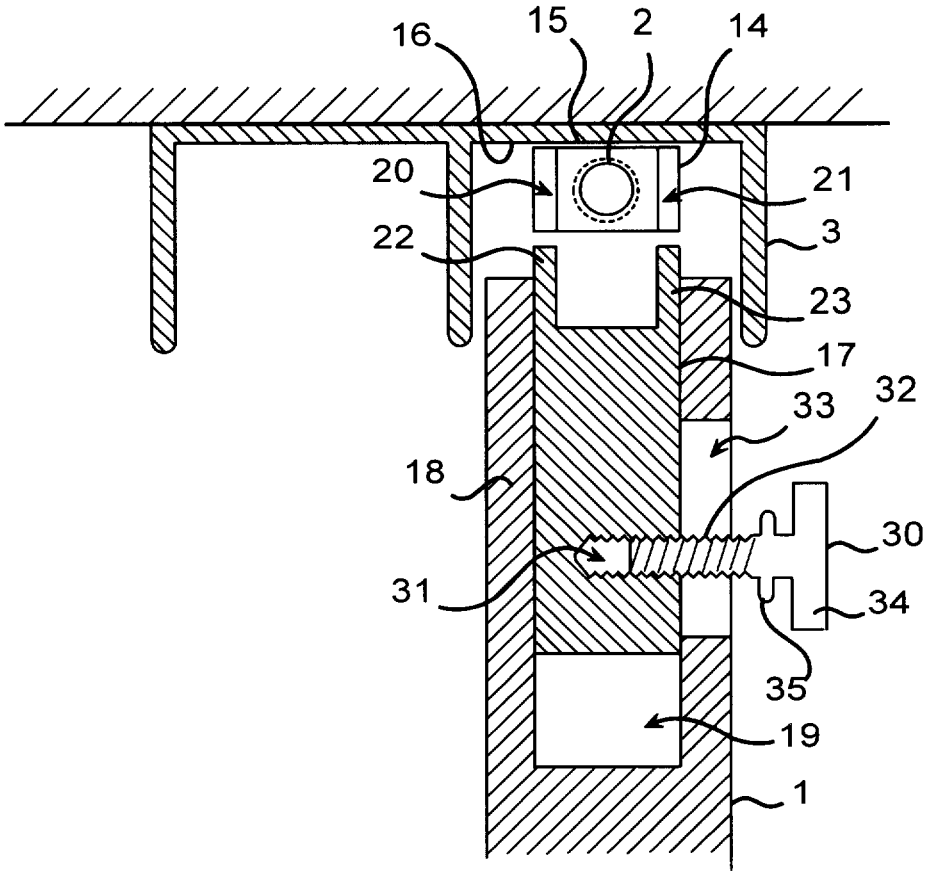
FIG. 2 is a cross-sectional diagrammatic view of the nut and drive screw mechanisms as installed in the upper track of a sliding panel, and the coupling bolt.
Figure 3:
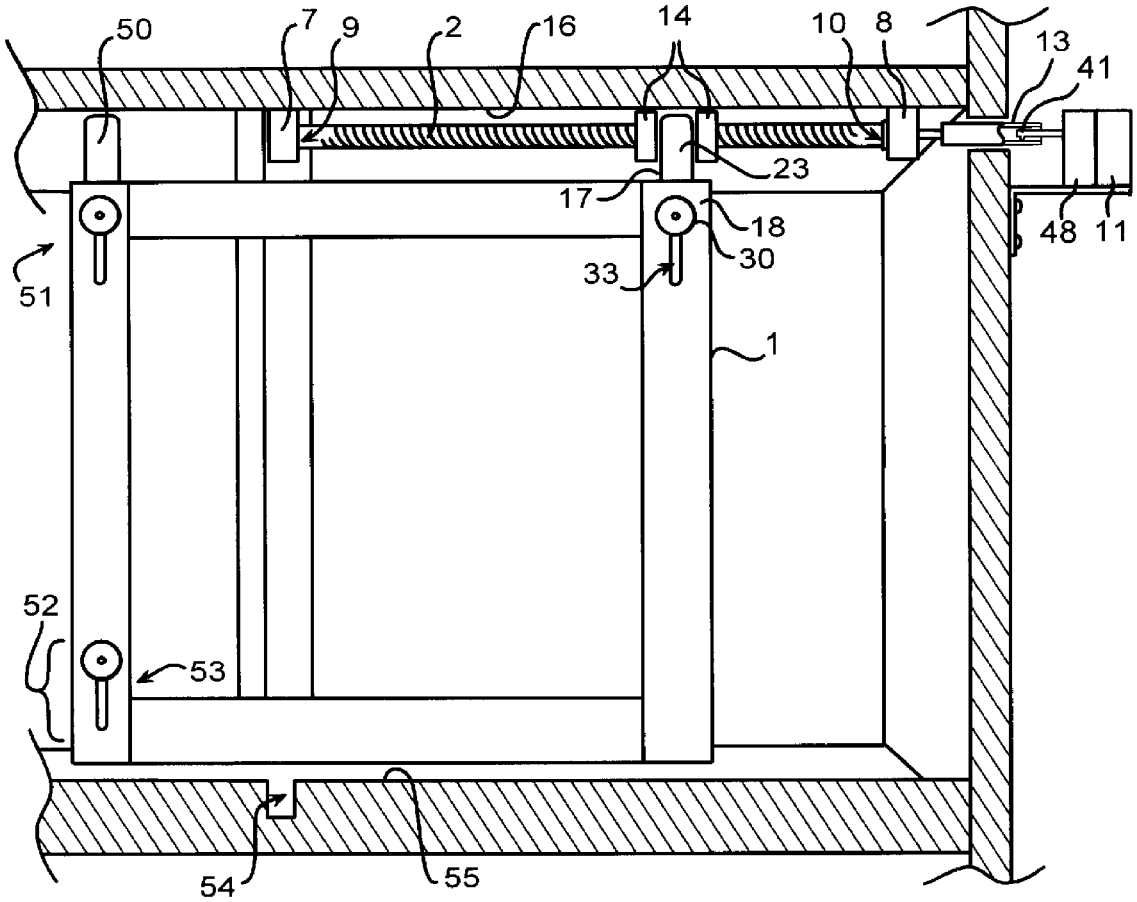
FIG. 3 is a partial cutaway view of the invention as installed in a household sliding glass window arrangement.

Referring now to the drawing, FIGS. 1–3 show an upper corner of a sliding panel 1. A drive screw 2 is rotatively mounted above the panel within the upper guide track 3 (unshown in FIG. 1). The drive screw 2 comprises an acme-threaded rod made of steel or other rigid, machinable material. The drive screw has a threaded portion 4 and an axis of rotation 5 substantially parallel to the direction of sliding movement 6 of the panel. The drive screw is rotatively held in place by a pair of bearings 7,8 located beyond opposite ends 9,10 of the threaded portion 4. Powered rotation of the screw is provided by a motor 11 whose torque is transmitted through gearing 12 and an accouplement 13. A nut 14 is threaded onto the threaded portion of the drive screw. The nut comprises a bearing surface 15 for contacting and sliding across the substantially flat channel 16 of the upper guide track 3. This prevents the nut from rotating so that it travels axially along the drive screw's axis of rotation as the drive screw rotates.

It should be noted that the outer surfaces of the nut may be shaped differently so as to slidingly engage guide tracks having a curved or other complex cross-section.

A coupling bolt 17, which extends from a top portion 18 of the panel 1 during powered operation. The bolt is retracted within a cavity 19 set into the edge of the panel during manual operation. Means are required for releasably attaching the bolt to the nut so that axial movement of the nut may be transmitted to the bolt, and thus the panel. In the preferred approach, these means are achieved by the nut having an "H" shape with slots 20,21 sized and dimensioned to allow the insertion of a pair of prongs 22,23 jutting upwardly from a top portion of the bolt. In FIG. 3, the prongs are shown having rounded edges to facilitate engagement with the slots in the nut.

Means for extending and retracting the bolt should be simple, easily installed and easily actuated by the user. The position of the bolt, whether extended or retracted must be releasably secured through securing means. Under the preferred approach, both means are satisfied by a thumb screw 30 which engages a threaded hole 31 set into a side of the bolt 17. The shaft 32 of the thumb screw extends through an oblong, substantially oval shaped slot 33 which extends between the inner cavity 19 and an outer surface of the panel. The head 34 of the thumb screw is enlarged with knurled edges to facilitate the user's grasp. When the thumb screw is in its loosened state, the bolt is allowed to freely slide between its extended and retracted positions. When the thumb screw is tightened, a flange portion 35 of it bears against the outer surface of the panel, thereby securing the position of the bolt through friction.

The outer surface of the panel should not be confused with the outside facing portion of the panel. When the sliding panel separates the inside of a house from the outside, such as with a sliding glass window, the thumb screw and its attendant features (including the described outer surface of the panel) are logically located on the inside facing side of the panel.

An electric motor 11 provides torque which is transmitted through transmission means to the drive screw. The preferred transmission means include an insulating accouplement 13 made from polycarbonate or other somewhat resilient, dielectric material so that the motor is electrically insulated from the metal parts of the panel, thereby reducing the risk of electric shock if a short develops in the motor. Resilient material will reduce the transmission of motor vibrations to the drive screw, panel and sill, thereby reducing noise during powered operation.

Primarily, however, the accouplement allows for variability in the distance between the drive screw and the motor. By varying the length of the accouplement, one can accommodate various panel sizes and wall designs having differently located and sized studs and sill arrangements.

Figure 4:
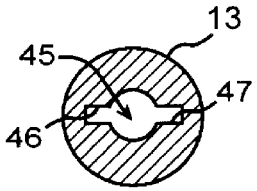
FIG. 4 is a cross-sectional view of the accouplement.

Means for attaching the accouplement to both the motor drive shaft and the drive screw are required. FIGS. 1–3 show that both the motor drive shaft and drive screw terminate at ends 40,41 each having a pair of outwardly projecting nibs 42,44. FIG. 4 shows a cross-section of the generally cylindrical accouplement 13 having a central channel 45 bored therethrough which is shaped to allow the insertion of the drive shaft at one end and the drive screw at the opposite end. The channel shape also provides bearing surfaces 46,47 for the nibs to transmit rotational motion.

Referring now to FIG. 1, the preferred embodiment of the motor will comprise worm-drive gear reduction 12. This provides an automatic locking mechanism when power is removed from the motor and the bolt is engaged with the nut.

An additional safeguard against forced entry is provided by a solenoid motor brake 48 associated with the motor 11. This type of motor braking and locking mechanism is well known to those skilled in the art, comprising a solenoid driven clamping assembly that is normally engaged. When the motor is not energized, its axle is locked. When power is applied to the motor, the solenoid is energized and releases the clamping structure.

Disengaging the bolt for manual operation is simple, since no alignment is necessary. However, engaging the bolt for powered operation requires that the bolt and nut be in substantial alignment. This is most easily accomplished by fully opening or closing the panel in the manual mode. While the bolt remains disengaged, the motor is run to move the nut to its fully open or closed position. The bolt may then be engaged, enabling powered operation.

Although the preferred embodiment describes an H-shaped nut as a means for coupling the bolt to the nut, this is not required. Other means for coupling the bolt to the nut are possible, such as one or more prongs sized to engage holes, one or more hooks positioned to engage loops (such as VELCRO brand fasteners), or one or more magnetic connection points. All that is required is that the means allow for coupling during both opening and closing movements.

Referring now to FIG. 3, a second extendible bolt 50 is slidingly mounted on an opposite, upper corner 51 of the panel 1. In its extended position, the second bolt hinders pitch deflection of the panel, thereby encouraging smooth movement of the panel along its track during powered operation.

A third extendible bolt structure 52 is slidingly mounted within a cavity in a lower corner 53 of the panel 1. This third bolt provides additional locking means for panel. The bolt is sized and dimensioned to engage a notch 54 in the upper surface of the lower sill 55. One or more notches may be provided to allow for locking the panel at various points along its range.

While the preferred embodiments of the invention have been described, modifications can be made and other embodiments may be devised without departing from the spirit of the invention and the scope of the appended claims.

What is claimed is:

1. A powered apparatus for providing translational motion for use with a sliding panel comprises:

a drive screw driven by a motor;

said drive screw having an axis of rotation;

a threaded nut driven by said screw; and, a coupling member for releasably coupling said nut to said panel, thereby transmitting axial movement of said nut to said panel;

wherein said nut comprises first and second bearing surface portions straddling said axis; and wherein said coupling member comprises a first end sized and dimensioned to bear against said bearing surface portions and a second end for mounting to said panel.

2. The apparatus of claim 1, wherein said axis is oriented in a direction corresponding to said translational motion.

3. The apparatus of claim 1, wherein said nut further comprises:

a third bearing surface for slidingly contacting a substantially fixed portion of said apparatus thereby preventing said nut from rotating beyond a given arc during rotation of said screw.

4. The apparatus of claim 1, wherein said coupling member comprises a bolt which is adapted to slidingly mount to said panel.

5. The apparatus of claim 4, wherein said first end comprises:

first and second prongs sized to engage said first and second surface portions respectively.

6. The apparatus of claim 1, wherein said coupling member comprises a bolt which is adapted to slidingly mount within a cavity of said panel; and means associated with said bolt for locking a position of said bolt within said cavity.

7. The apparatus of claim 6, which further comprises:

said cavity being adapted to be located proximate to an upper corner of said panel.

8. The apparatus of claim 1, which further comprises an insulating accouplement located mechanically between said motor and said drive screw.

9. The apparatus of claim 1, which further comprises means associated with said apparatus for preventing movement of said nut along said axis when said motor is unpowered.

10. The apparatus of claim 9, wherein said means for preventing comprise:

a worm gear transmission between said motor and said drive screw; and a solenoid-activated means for locking said motor.

11. The apparatus of claim 1, wherein said nut and said drive screw are sized and dimensioned for lying within a space between said upper track and said panel.

12. The combination of a sliding panel with an apparatus for providing translational motion to said panel, said apparatus comprises:

a drive screw driven by a motor;

said drive screw having an axis of rotation;

a threaded nut driven by said screw; and, a coupling member releasably coupling said nut to said panel, thereby transmitting axial movement of said nut to said panel;

wherein said nut comprises first and second bearing surface portions straddling said axis; and wherein said coupling member comprises a first end sized and dimensioned to bear against said bearing surface portions and a second end mounted to said panel.

13. The combination of claim 12, wherein said second end includes means for slidingly mounting to said panel.

14. The combination of claim 13, wherein said first end comprises:

first and second prongs sized to engage said first and second surface portions respectively.

15. The combination of claim 13, wherein said coupling member comprises:

a first bolt which is slidingly mounted within a first cavity of said panel, said first cavity having an open end; and means associated with said first bolt for locking a position of said first bolt within said first cavity.

16. The combination of claim 15, which further comprises:

said first cavity being located proximate to a first upper corner of said panel; and a second bolt sized and dimensioned to be slidingly mounted in a second cavity in said panel, said second cavity being located proximate to a second opposite upper corner of said panel.

17. The combination of claim 12, which further comprises an electrically insulating accouplement located mechanically between said motor and said drive screw.

18. The combination of claim 12, which further comprises means associated with said apparatus for preventing movement of said nut along said axis when said motor is unpowered.

19. The combination of claim 18, wherein said means for preventing comprise:

a worm gear transmission between said motor and said drive screw.

20. A method for translationally moving a sliding panel comprises:

rotatably mounting a drive screw having a rotational axis proximate to said panel;

threading a nut upon said screw;

releasably coupling said panel to said nut; and rotating said drive screw, thereby causing said nut to move axially and said panel to move translationally;

wherein said step of releasably coupling comprises:

forming first and second bearing surface portions straddling said axis on said nut;

mounting a retractable bolt to said panel; and resting portions of said bolt against said bearing surfaces.

* * * * *